US006708955B2

(12) United States Patent
Cummings

(10) Patent No.: US 6,708,955 B2
(45) Date of Patent: Mar. 23, 2004

(54) LATTICE INSERT

(76) Inventor: Laurence Rudolph Cummings, 2250 King Ct. #30, San Luis Obispo, CA (US) 93401

( * ) Notice: Subject to any disclaimer, the term of this patent is extended or adjusted under 35 U.S.C. 154(b) by 0 days.

(21) Appl. No.: 10/154,667

(22) Filed: May 22, 2002

(65) Prior Publication Data

US 2002/0190247 A1 Dec. 19, 2002

Related U.S. Application Data

(60) Provisional application No. 60/296,338, filed on Jun. 7, 2001.

(51) Int. Cl.[7] ..... E04H 17/00

(52) U.S. Cl. ..... 256/1; 256/19; 256/32

(58) Field of Search ..... 256/1, 9, 24, 32

(56) References Cited

U.S. PATENT DOCUMENTS 5,865,427 A * 2/1999 Cowan ..... 256/19

* cited by examiner

*Primary Examiner*—Lynne H. Browne
*Assistant Examiner*—Michael P. Ferguson

(57) ABSTRACT

An insert consisting of a plastic square that is fastened to a plastic garden-lattice that affects the lattice's functional and ornamental characteristics. This device is dispersed throughout the lattice according to personal preference to achieve varying degrees of both function and ornamentation, with regards to protection from the elements, colors, composition, letters, numbers, embossing, etc.

1 Claim, 2 Drawing Sheets

LATTICE INSERT

This application is a continuation of U.S. Provisional Patent Application (60/296,338) filed on Jun. 7, 2001.

BACKGROUND OF THE INVENTION

The invention, relates to the use of plastic inserts as a functional and aesthetic addition to plastic garden-lattice panels. Previously, several types of inserts have been proposed for use with a wire mesh. For example. in U.S. Pat. No. 4,651,975 (03-1987). Howell discloses a chain link fence insert device. In U.S. Pat. No. 3,964,197 (06-1976). Tucker et al. discloses a self-locking chip usable on a wire mesh in order to display intelligence. Many other inserts have been invented for use in a wire mesh. (e.g. chain link fence) or array for the purpose of creating signs, etc. None, however, suggest that their insert be modified for use with garden lattice and, as they haven't been implemented by those skilled in the art, it has been demonstrated that the advantage has gone unappreciated.

Today plastic garden-lattice panels are used for privacy, shade and wind break. While partially succeeding in doing this, they lack the ability to provide the consumer with the choice of how much privacy, shade or wind break they might desire other than resorting to growing plants to fill in the holes.

The present invention is directed towards overcoming this drawback of the prior art by providiing the consumer with, not only the ability to suit individual taste with regards to the aforementioned, but do so in a manner that suits his or her aesthetic taste.

SUMMARY OF THE INVENTION

This device is a plastic insert that is fastened to plastic garden-lattice by the use of one of several fastening methods. The prefered embodiment would be of a weather-resistant, multi-colored, translucent material that would be inserted into the lattice to achieve the consumer's needs for privacy, decoration and protection from the elements. The inserts could also be personalized with numbers and letters for street addresses, or embossed as well as other means to satisfy individual interest.

Although the description above contains many specifities, these should not be construed as limiting the scope of the invention but merely providing illustrations of some of the presently preferred embodiments of this invention. For example, it's current system of fastening with a snap-in fit could be replaced with another system deemed more desirable at a later date, (e.g. twist-locking) etc.

Thus the scope of the invention should be determined by the appended claim and it's legal equivalents, rather than by the examples given here.

While the invention has been shown and described with respect to a specific preferred embodiment, it is obvious that equivalent alterations and modifications will occur to others skilled in the art in light of the foregoing description. The present invention includes all such equivalent alterations and modifications, and is limited only by the spirit and scope of the invention.

DETAILED DESCRIPTION OF THE INVENTION

Figure 1:
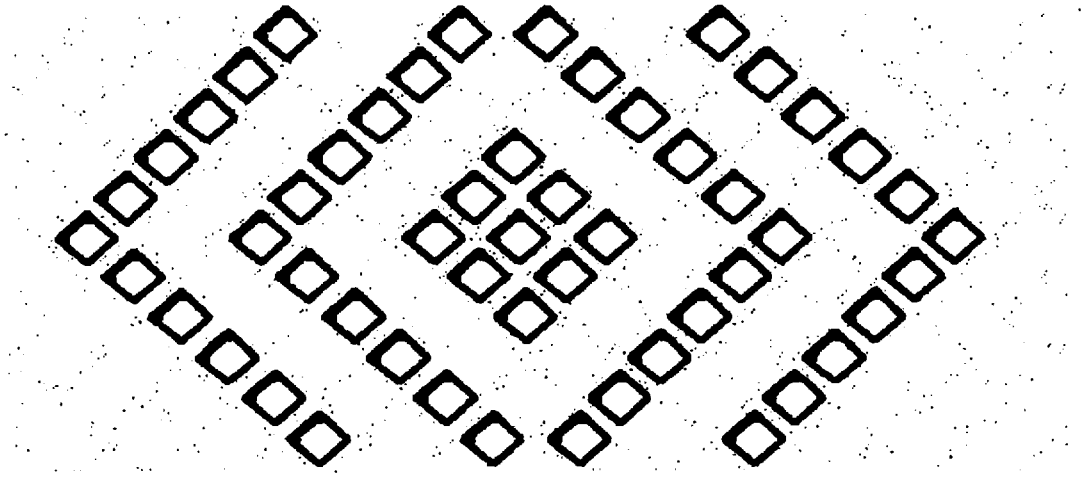
FIG. 1 is a front view of the garden-lattice with inserts dispersed within.
Figure 2:
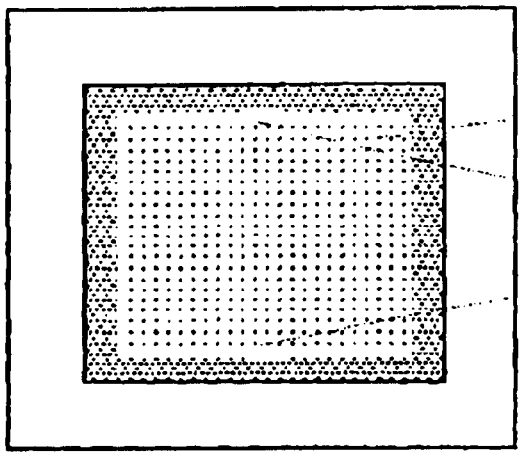
FIG. 2 is a front view of the insert attached to the lattice showing one embodiment of the device.
Figure 3:
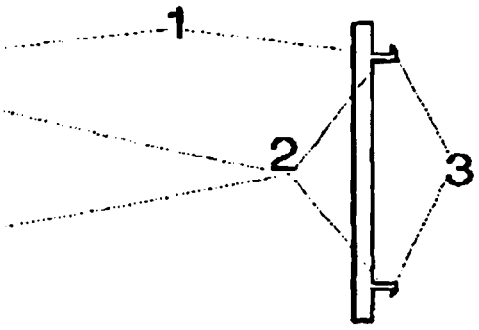
FIG. 3 is a side view of the device.
Figure 4:
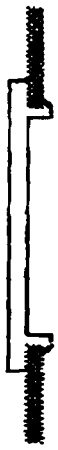
FIG. 4 is a side view of the insert installed in the lattice (shaded).

One preferred embodiment of the present invention would be the process of using a multi-colored, translucent, polycarbonate insert comprising of a face plate (1 in FIGS. 2 & 3), the mounting arms (2 in FIGS. 2 & 3), and the mounting barb (3 in FIG. 3), in continuation with a plastic garden lattice. The insert is attached to the lattice by applying pressure to the front side of the unit, causing the mounting arms to flex sufficiently enough to allow mounting barbs to snap through to the back side of the lattice, locking the unit in place.

What is claimed is:

1. A fence assembly comprising:

a plastic garden-lattice having a front side and a rear side, the garden-lattice comprising a plurality of flat plastic slats, each slat having a width, a thickness, a front side and a rear side, the slats being crossed in a lattice arrangement defining a plurality of lattice apertures separated by the width of the slats, the apertures each having a generally rectangular shape; and a plastic lattice insert comprising a generally rectangular face-plate having sufficient width to overlap at least two opposing edges of one of said plurality of lattice apertures; and opposing flexible mounting arms for attaching the face-plate to the garden-lattice, the mounting arms being unitarily constructed with the face-plate and extending rearwardly from the face-plate, each mounting arm having a barb at a distal end of the mounting arm opposite the face-plate for securing the lattice insert within said lattice aperture, said barb being tapered for insertion into said lattice aperture and having an abutment surface parallel to the face-plate for locking the lattice insert within said lattice aperture;

wherein when the mounting arms of the lattice insert are inserted into said lattice aperture from the front side of the garden-lattice, the mounting arms flex radially outward, using the flexible nature of the arms, to abut said opposing edges of said aperture and to engage said barbs with the rear side of the garden-lattice in a locking relationship, the face-plate abutting the front side of at least two opposing slats of the garden-lattice, and the abutment surface of said barbs abutting the rear side of said opposing slats;

wherein the lattice insert provides means for alteration of the characteristics of the garden-lattice with regards to color, privacy, and shelter from the elements.

* * * * *